US008684355B2

(12) United States Patent
Nieda et al.

(10) Patent No.: US 8,684,355 B2
(45) **Date of Patent: *Apr. 1, 2014**

(54) SHEET CONVEYANCE APPARATUS AND PRINTING APPARATUS

(71) Applicant: Canon Kabushiki Kaisha, Tokyo (JP)

(72) Inventors: Kengo Nieda, Kawasaki (JP); Koichiro Kawaguchi, Yokohama (JP); Toshiki Takeuchi, Yokohama (JP); Ryosuke Sato, Kawasaki (JP); Shigeru Toriihara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/758,402

(22) Filed: Feb. 4, 2013

(65) Prior Publication Data

US 2013/0140768 A1 Jun. 6, 2013

Related U.S. Application Data

(63) Continuation of application No. 13/489,316, filed on Jun. 5, 2012, now Pat. No. 8,387,976, which is a continuation of application No. 12/965,787, filed on Dec. 10, 2010, now Pat. No. 8,215,638.

(30) Foreign Application Priority Data

Oct. 22, 2010 (JP) ..... 2010-237468

(51) Int. Cl.
*B65H 9/16* (2006.01)

(52) U.S. Cl.
USPC ..... 271/251; 271/272

(58) Field of Classification Search
USPC ..... 271/226, 251, 252, 272
See application file for complete search history.

(56) References Cited

U.S. PATENT DOCUMENTS 8,215,638 B2 * 7/2012 Nieda et al. ..... 271/240
8,387,976 B2 * 3/2013 Nieda et al. ..... 271/248

FOREIGN PATENT DOCUMENTS

JP 2002226077 A * 8/2002

* cited by examiner

*Primary Examiner* — Michael McCullough
(74) *Attorney, Agent, or Firm* — Canon USA Inc. IP Division

(57) ABSTRACT

A sheet conveyance apparatus includes: a guide unit for guiding the side end of the sheet; a first roller pair arranged on the downstream side of the guide unit for conveying the sheet, including a driven roller held in contact with a whole sheet in a sheet width direction; and a second roller pair having a conveyance roller arranged on the downstream side of the roller and adapted to convey the sheet, and a plurality of pinch rollers pinching the sheet in cooperation with the conveyance roller, wherein each of the plurality of pinch rollers applies to the sheet a conveyance force inclined toward a conveyance path side end, which is nearer to the pinch roller, and wherein the smaller the distance between the pinch roller and the conveyance path side end, the greater the inclination of the conveyance force thereof.

18 Claims, 10 Drawing Sheets

SHEET CONVEYANCE APPARATUS AND PRINTING APPARATUS

CROSS-REFERENCE TO RELATED APPLICATIONS

This application is a continuation of U.S. patent application Ser. No. 13/489316 filed Jun. 5, 2012, which is a continuation of U.S. patent application Ser. No. 12/965,787 filed Dec. 10, 2010 and issued as U.S. Pat. No. 8,215,638, which claims priority from Japanese Patent Application No. 2010-237468 filed Oct. 22, 2010, all of which are hereby incorporated by reference herein in their entirety.

BACKGROUND OF THE INVENTION

1. Field of the Invention

The present invention relates to a sheet conveyance apparatus conveying sheets by using a conveyance roller while suppressing meandering of the sheets, and to a printing apparatus performing printing on sheets.

2. Description of the Related Art

Japanese Patent Application Laid-Open No. 2007-225947 discusses a printing apparatus in which there are provided in a paper path route for a roll of paper a pair of right and left regulating guides preventing meandering. The right and left guides are moved so as to make the distance between the guides, which regulate the positions of the right and left side ends of the roll paper, smaller than the width of the roll paper to thereby rectify the attitude of the roll paper, and then the guides are moved to positions corresponding to the width of the roll paper, thereby making it possible to prevent meandering of the roll paper.

In the apparatus discussed in Japanese Patent Application Laid-Open No. 2007-225947, conveyance rollers are provided on the upstream and downstream sides of the paper width guide to sandwich and convey a roll of paper. And, when performing meandering rectification, the press contact of the conveyance rollers is released, and the paper roll end portions are further pushed beyond the paper width by a guide unit. Besides, the position of the guide unit is controlled to move according to the width dimension of the roll paper input to the apparatus beforehand.

When conveyance is performed while effecting positional regulation on the side end portions of the continuous paper paid out of the roll by means of the paper width guide, twisting is generated in the portion of the continuous paper between the paper width guide and the upstream side conveyance roller or between the paper width guide and the downstream side conveyance roller, resulting in partial paper uplift or creases. Further, depending upon the position of the paper width guide, the paper width guide presses the continuous paper in the width direction, so that the sheet is placed in a swollen state. If the continuous paper is held in this state by the downstream side conveyance roller, creases will be generated.

Further, to improve the conveyance precision for the roll paper and to suppress damage of the roll paper due to the pressure by the conveyance rollers, it is necessary for the conveyance rollers to apply pressure uniformly onto the paper. As an advantageous construction in terms of cost and size in uniformly applying pressure, a roller opposed to the conveyance rollers and driven to rotate may be divided in the paper width direction.

However, it is rather difficult to arrange the respective rotation shafts of the divided driven rollers to be parallel with high precision, relative to the rotation shafts of the conveyance rollers. If the rotation shafts of the adjacent driven rollers are inclined and the continuous paper is huddled during conveyance, creases and jamming are generated.

SUMMARY OF THE INVENTION

The present invention is directed to a sheet conveyance apparatus conveying a sheet while guiding side end portions thereof by a guide unit, wherein it is possible to suppress generation of creases and jamming.

According to an aspect of the present invention, there is provided a sheet conveyance apparatus comprising: a guide unit held in contact with a side end portion of a conveyed sheet to guide the side end portion of the sheet; a first roller pair arranged on a downstream side of the guide unit, including a driven roller held in contact with a whole sheet in a sheet width direction, and adapted to convey the sheet while pinching the same; and a second roller pair having a conveyance roller arranged on the downstream side of the roller and adapted to convey the sheet, and a plurality of pinch rollers pinching the sheet in cooperation with the conveyance roller, wherein each of the plurality of pinch rollers applies to the sheet a conveyance force inclined toward a conveyance path side end, which is nearer to the pinch roller, and wherein the smaller the distance between the pinch roller and the conveyance path side end, the greater the inclination of the conveyance force thereof.

According to the present invention, it is possible to provide a sheet conveyance apparatus conveying a sheet while guiding a side end portion of the sheet by a guide unit, wherein it is possible to suppress generation of creases and jamming.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the following, an exemplary embodiment of a printing apparatus using the ink jet system will be described. The printing apparatus of the present exemplary embodiment is a high speed line printer which uses a continuous sheet in the form of a roll and which can be used for both one-sided printing and two-sided printing. It is suitable, for example, to a field where printing is performed in large quantities as in the case of a printing laboratory. The present invention is applicable to a printing apparatus such as a printer, a multifunction printer, or a facsimile apparatus. Further, apart from a printing apparatus, the present invention is also widely applicable to various apparatuses such as industrial apparatuses (an apparatus for manufacturing various devices, an inspection apparatus, etc.) for use in a plant or the like of which the operation time is designated by the user and which requires a long time for the initializing operation at the start.

Figure 1:
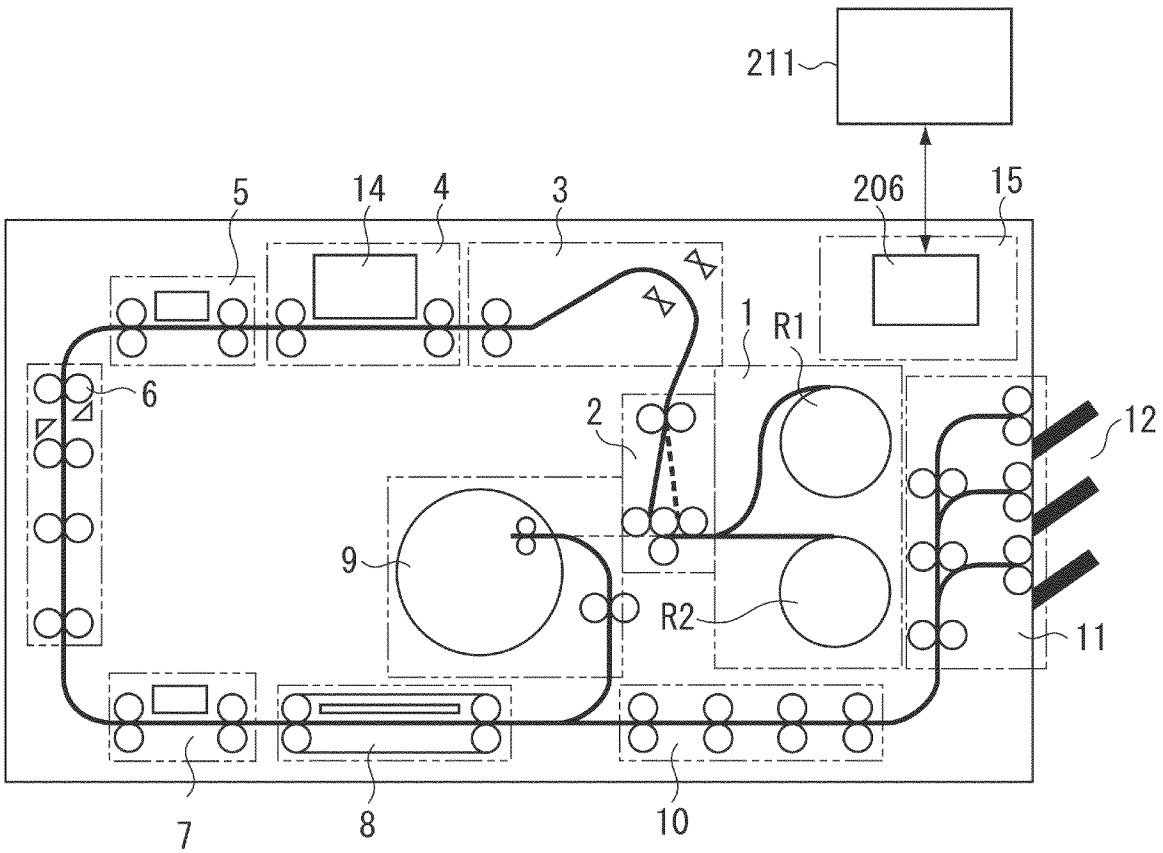
FIG. 1 is a schematic diagram illustrating the inner construction of a printing apparatus.

FIG. 1 is a schematic sectional view illustrating the inner construction of a printing apparatus. The printing apparatus of the present exemplary embodiment uses a rolled-up sheet, and allows two-sided printing on a first surface of a sheet and on a second surface that is the reverse side thereof. Roughly speaking, there are provided inside the printing apparatus a sheet supply unit 1, a decurling unit 2, a skew feed correction unit 3, a printing unit 4, an inspection unit 5, a cutter unit 6, an information recording unit 7, a drying unit 8, a reversing unit 9, a discharge conveyance unit 10, a sorter unit 11, a discharge unit 12, a moistening unit 20, and a control unit 13. The sheet is conveyed along a sheet conveyance path indicated by the solid line in the drawing by a conveyance mechanism consisting of roller pairs and a belt. Each processing is performed at each unit.

The sheet supply unit 1 is a unit for holding and supplying a continuous sheet in the form of a roll. The sheet supply unit can accommodate two rolls R1 and R2, allowing selectively drawing-out and supplying the sheet. The number of rolls that can be accommodated is not restricted to two; it may be one or three or more.

The decurling unit 2 is a unit for reducing curling (warpage) of the sheet supplied from the sheet supply unit 1. At the decurling unit 2, two pinch rollers are used for one drive roller to pass the sheet in a curved state so as to impart to the sheet the reverse warpage to the curling, whereby a decurling force is exerted to reduce the curling.

The skew feed correction unit 3 is a unit for correcting skew feed (an inclination with respect to the proper advancing direction) of the sheet having passed the decurling unit 2. A sheet end portion on a side serving as a reference is pressed against a guide member, whereby the skew feed of the sheet is corrected.

The printing unit 4 is a unit performing printing processing from above on the sheet being conveyed by means of a printing head 14 to thereby form an image. More specifically, the printing unit 4 is a processing unit performing a predetermined processing on the sheet. The printing unit 4 is also equipped with a plurality of conveyance rollers for conveying the sheet. The printing heads 14 have line type printing heads having ink jet type nozzle rows formed over a range covering the maximum sheet width. The printing heads 14 are a plurality of printing heads arranged in parallel along the conveyance direction. In the present exemplary embodiment, there are provided seven printing heads corresponding to the seven colors of cyan (C), magenta (M), yellow (Y), light cyan (LC), light magenta (LM), gray (G), and black (K). The number of colors and the number of printing heads are not restricted to seven. As the ink jet system, it is possible to adopt a system using heat generation elements, a system using piezoelectric elements, a system using electrostatic elements, a system using Micro Electro Mechanical Systems (MEMS) elements, etc. The inks of the different colors are respectively supplied from ink tanks to the printing heads 14 via ink tubes.

The inspection unit is a unit for optically reading an inspection pattern or an image printed on the sheet by the printing unit 4 by means of a scanner and inspecting the condition of the nozzles of the printing head, the sheet conveyance state, the image position, etc. to determine whether the image has been correctly printed or not. The scanner has a charge-coupled device (CCD) image sensor, a Metal Oxide Complementary Semiconductor (CMOS) image sensor or the like.

The cutter unit 6 is a unit equipped with a mechanical cutter for cutting the sheet in a predetermined length after the printing. The cutter unit 6 is also equipped with a plurality of conveyance rollers for sending out the sheet to the next step.

The information recording unit 7 is a unit for recording on a non-print region of the cut sheet printing information (specific information) such as a print serial number and a date. The printing is effected by an ink jet system, a heat transfer system or the like printing the letters, codes, etc. On the upstream side of the information recording unit 7 and on the downstream side of the cutter unit 6, there is provided a sensor 23 detecting the leading edge of the cut sheet. More specifically, the sensor 23 detects the sheet edge between the cutter unit 6 and the recording position where the recording is performed by the image recording unit 7, and, based on the timing with which the detection is effected by the sensor 23, the information recording timing for the information recording unit 7 is controlled.

The drying unit 8 is a unit for heating the sheet that has undergone printing at the printing unit 4 to dry the printed ink in a short time. Inside the drying unit 8, hot air is applied at least from below to the passing sheet to dry the surface on which the ink has been printed. The drying system is not restricted to the one applying hot air; it is also possible to adopt a system in which electromagnetic waves (ultraviolet rays, infrared rays or the like) are applied to the sheet surface.

The sheet conveyance route formed by the sheet supply unit 1 through the drying unit 8, described above, will be referred to as a first route. The first route makes a U-turn in the section between the printing unit 4 and the drying unit 8, with the cutter unit 6 situated halfway in the U-turn shape.

The reversing unit 9 is a unit for temporarily taking up the portion of the continuous sheet that has undergone front-side printing in the case where two-sided printing is performed, to reverse the portion of the sheet. The reversing unit 9 is provided halfway in the route (loop path) (referred to as the second route) which is used to supply the sheet having passed the drying unit 8 to the printing unit 4 again and which extends from the drying unit 8 to the printing unit 4 by way of the decurling unit 2. The reversing unit 9 is equipped with a take-up rotary member (drum) for taking up the sheet. The portion of the continuous sheet that has undergone front-side printing but has not been cut is temporarily taken up by the take-up rotary member. When the taking-up is over, the take-up rotary member makes a reverse rotation, and the portion of the sheet that has been taken up is supplied to the decurling unit 2, and then sent to the printing unit 4. Since the sheet has been reversed, it can undergo back-side printing at the printing unit 4. The two-sided printing operation will be described more specifically below.

The discharge conveyance unit 10 is a unit for conveying the sheet cut by the cutter unit 6 and dried by the drying unit 8 to deliver the sheet to the sorter unit 11. The discharge conveyance unit 10 is provided in a route (referred to as a third route) different from the second route in which the reversing unit 9 is provided. To selectively guide the sheet conveyed through the first route either to the second route or the third route, a route switching mechanism with a movable flapper is provided at the route branching-off position.

The sorter unit 11 and the discharge unit 12 are provided at a side portion of the sheet supply unit 1 and at the terminal end of the third route. The sorter unit 11 is a unit for sorting the sheets that have undergone printing into groups as needed. The sorted sheets are discharged onto the discharge unit 12 consisting of a plurality of trays. In this way, the third route extends below the sheet supply unit 1, and helps to discharge sheets on the opposite side of the printing unit 4 and the drying unit 8 with respect to the sheet supply unit 1.

The moistening unit 20 is a unit for generating a moistening gas (air) and supplying it to the portion between the printing head 14 of the printing unit 4 and the sheet. Owing to the moistening unit, it is possible to suppress drying of the ink in the nozzles of the printing head 14. As the moistening system of the moistening unit 20, a vaporization system, a water spraying system, a steam system or the like can be adopted. Examples of the vaporization system includes, apart from the rotary type system of the present exemplary embodiment, a moisture permeable film system, a drip permeation system, and a capillary system. Examples of the water spraying system include an ultrasonic wave system, a centrifugal system, a high pressure spray system, and a two-fluid spray system. Examples of the steam system include a steam piping system, an electric heating system, and an electrode system. The moistening unit 20 and the printing unit 4 are connected to each other by a first duct 21, and the moistening unit 20 and the drying unit 8 are connected to each other by a second duct 22. When drying the sheet, a high humidity and high temperature gas is produced in the drying unit 8. This gas is introduced into the moistening unit 20 via the second duct 22, and is utilized as an auxiliary energy for the production of the moistening gas in the moistening unit 20. And, the moistening gas produced in the moistening unit 20 is introduced into the printing unit via the first duct 21.

The control unit 13 is a unit serving to control each portion of the entire printing apparatus. The control unit 13 has a controller (control unit) equipped with a central processing unit (CPU), a storage device, and various control units, an external interface, and an operation unit 15 allowing the user to perform input and output. The operation of the printing apparatus is controlled based on a command from a host apparatus 16 such as the controller or a host computer connected to the controller via the external interface.

Figure 2:
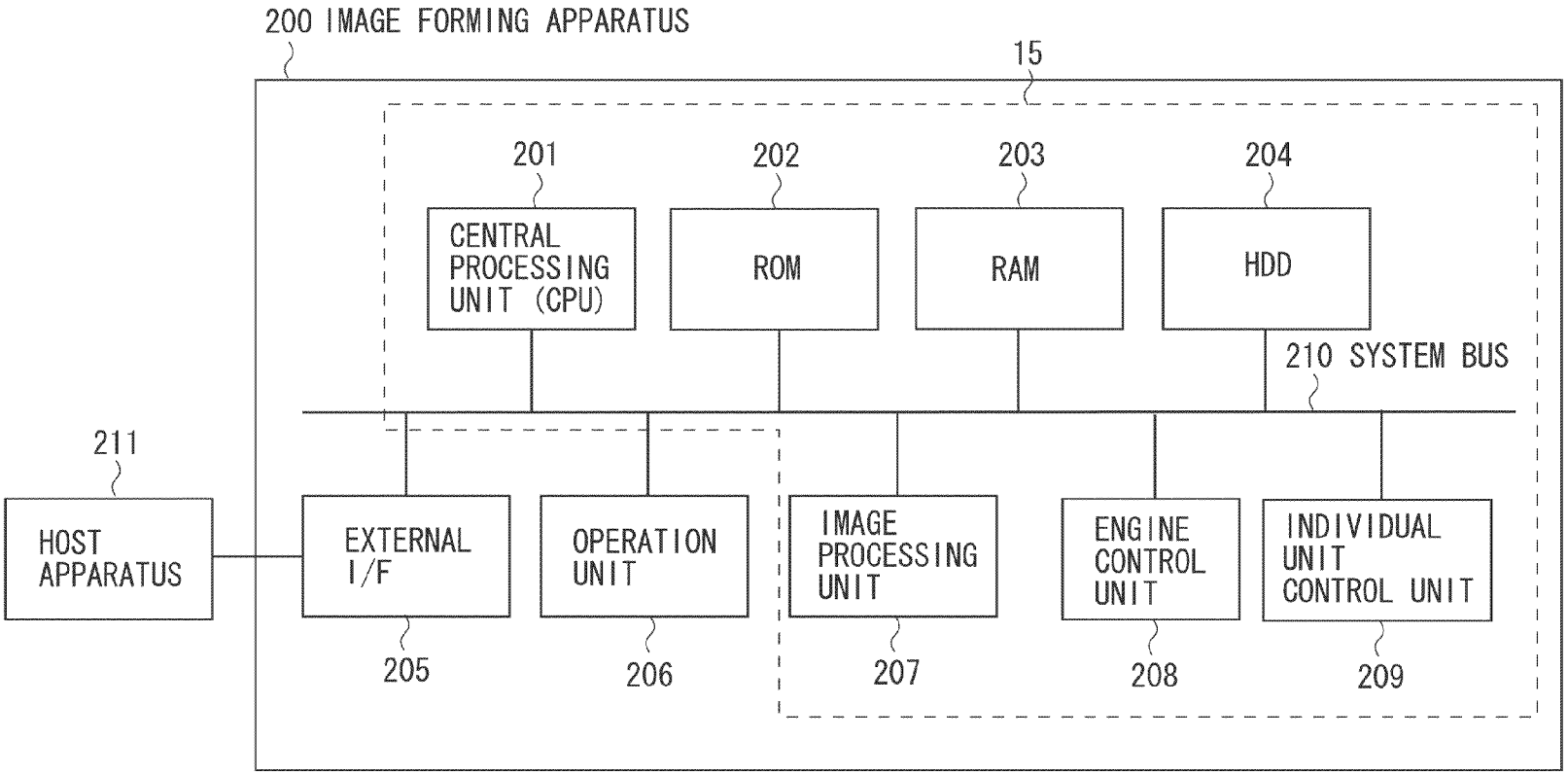
FIG. 2 a block diagram illustrating a control unit.

FIG. 2 is a block diagram illustrating the concept of the control unit 13. The controller (encircled by the dashed line) contained in the control unit 13 is formed by a CPU 201, a read-only memory (ROM) 202, a random-access memory 203, a hard disk drive (HDD) 204, an image processing unit 207, an engine control unit 208, and an individual unit control unit 209. The CPU 201 controls the operation of the units of the printing apparatus in an overall fashion. The ROM 202 stores programs to be executed by the CPU 201 and fixed data necessary for the various operations of the printing apparatus. The RAM 203 is used as a work area for the CPU 201, or is used as a temporary storage region for various items of received data, or stores various kinds of setting data. The HDD (hard disk) 204 is capable of storing and reading programs to be executed by the CPU 201, printing data, and setting information necessary for various operations of the printing apparatus. The operation unit 15 is an input/output interface for the user, and includes an input portion having hard keys and a touch panel, and an output portion such as a display or a voice generator presenting information. For example, a display with a touch panel is used, by which the operational status of the apparatus, printing situation, maintenance information (such as residual ink amount, residual sheet amount, and maintenance status), etc. are informed to the user. The user can input various kinds of information via the touch panel.

When high speed data processing is required, a dedicated processing unit is used. The image processing unit 207 performs image processing on print data treated in the printing apparatus. The color space of input image data (e.g., YCbCr) is converted to a standard red/green/blue (RGB) color space (e.g., sRGB). Further, various image processing operations, such as resolution conversion, image analysis, and image correction, are performed on the image data as needed. The printing data obtained through these image processing operations is stored in the RAM 203 or the HDD 204. The engine control unit 208 performs drive control on the printing head 14 of the printing unit 4 according to the printing data based on the control command received from the CPU 201, etc. Further, the engine control unit 208 controls the conveyance mechanism of each portion inside the printing apparatus. The individual unit control unit 209 is a sub controller for individually controlling each of the sheet supply unit 1, the decurling unit 2, the skew feed correction unit 3, the inspection unit 5, the cutter unit 6, the information recording unit 7, the drying unit 8, the reversing unit 9, the discharge conveyance unit 10, the sorter unit 11, the discharge unit 12, and the moistening unit 20. Based on the command from the CPU 201, the operation of each unit is controlled by the individual unit control unit 209. The external interface 205 is an interface (I/F) for connecting the controller to the host apparatus 16; it is a local I/F or a network I/F. The above components are connected together by a system bus 210.

The host apparatus 16 is an apparatus serving as a supply source of image data for causing the printing apparatus to perform printing. The host apparatus 16 may be a general-purpose or a dedicated computer, or a dedicated image apparatus such as an image capture with an image reading unit, a digital camera, or a photo storage. In the case in which the host apparatus 16 is a computer, an operating system (OS), application software producing image data, and a printer driver for the printing apparatus are installed in memory contained in the computer. It is not requisite to realize all of the above processing operations with software; it is also possible to realize a part or all of the processing operations with hardware.

Next, the basic operation at the time of printing will be described. The printing operation differs between the one-sided printing mode and the two-sided printing mode, so that the operation in each mode will be described.

Figure 3:
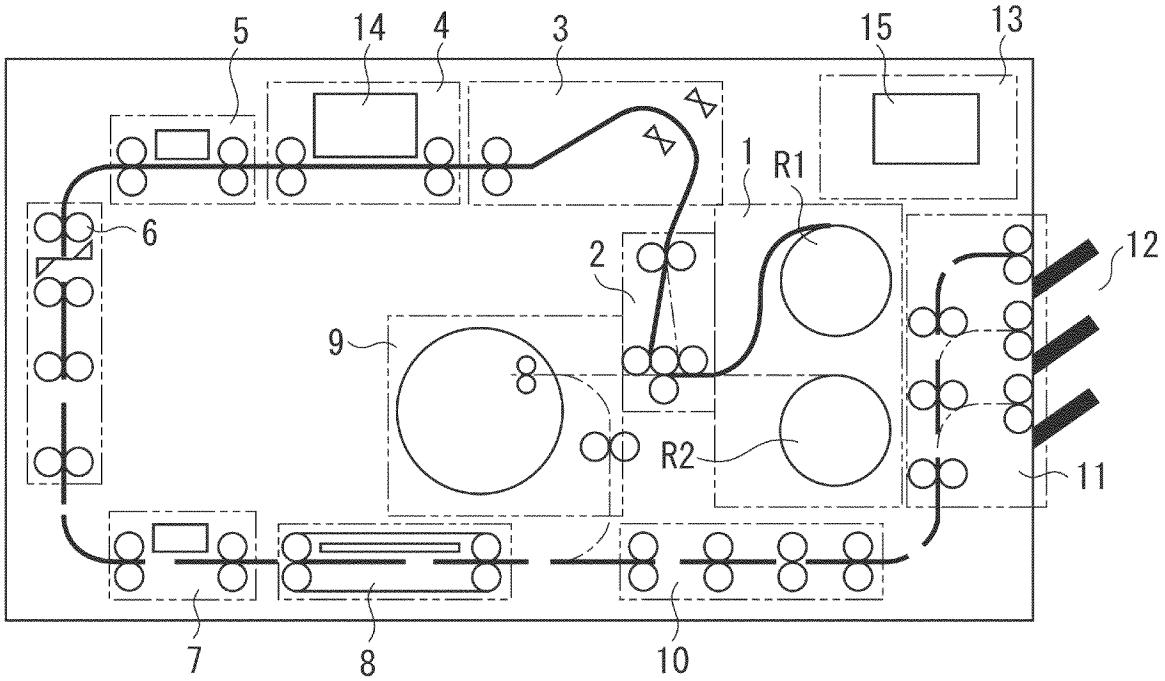
FIG. 3 is a diagram for illustrating an operation in a one-sided printing mode.

FIG. 3 is a diagram for illustrating the operation in the one-sided printing mode. The conveyance route by which the sheet supplied from the sheet supply unit 1 undergoes printing and is discharged to the discharge unit 12 is indicated by a bold line. The sheet supplied from the sheet supply unit 1 and processed in the decurling unit 2 and the skew feed correction unit 3 undergoes front-surface (first surface) printing in the printing unit 4. Images of a predetermined unit length in the conveyance direction (referred to as unit images) are successively printed on an elongated continuous sheet to form a plurality of images side by side. The sheet that has undergone printing passes the inspection unit 5 to be cut into unit images at the cutter unit 6. Printing information is recorded as needed on the back surfaces of the cut sheets by the recording unit 7. And, the cut sheets are conveyed one by one to the drying unit 8 to undergo drying. After this, the cut sheets pass the discharge conveyance unit 10 to be successively discharged to and stacked in the discharge unit 12 of the sorter unit 11. On the other hand, the sheet left on the printing unit 4 side in the cutting of the last unit image is sent back to the sheet supply unit 1, and the sheet is taken up by a roll R1 or R2. In this way, in the one-sided printing mode, the sheet passes the first route and the third route but not the second route.

Figure 4:
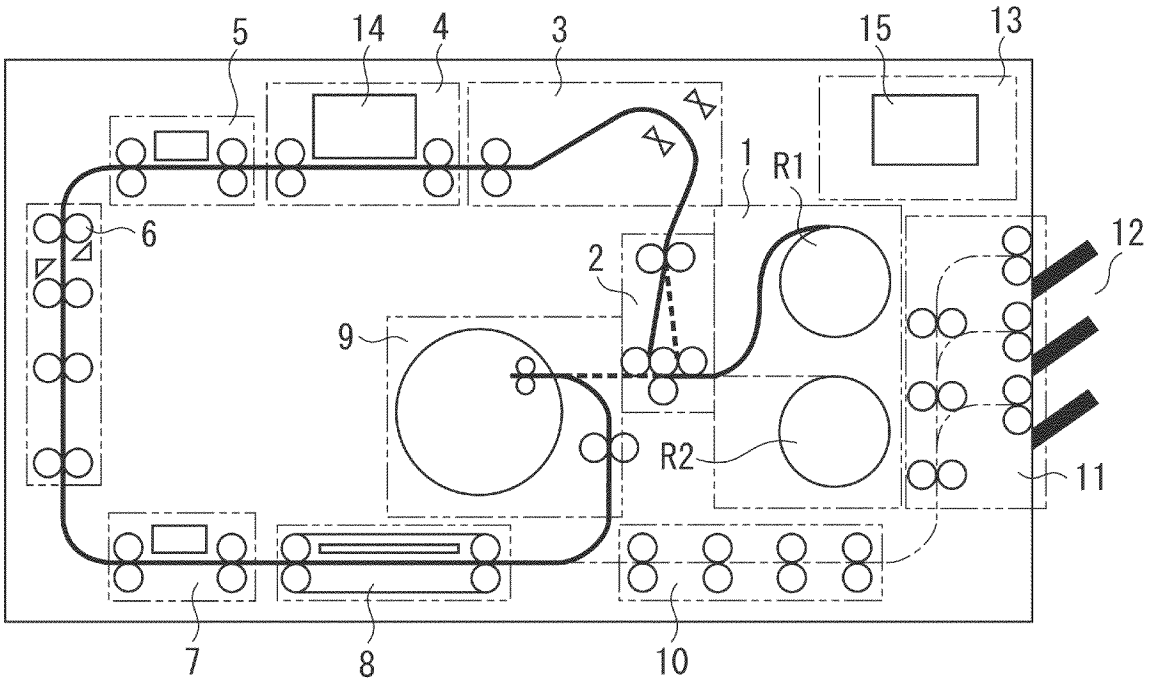
FIG. 4 is a diagram for illustrating an operation in a two-sided printing mode.

FIG. 4 is a diagram for illustrating the operation in the two-sided printing mode. In two-sided printing, a back-surface (second surface) printing sequence is executed subsequently to the front-surface (first surface) printing sequence. In the first, front-surface printing sequence, the operation at each of the sheet supply unit 1 through the inspection unit 5 is the same as that of the one-sided printing described above. No cutting operation is performed at the cutter unit 6, and the continuous sheet is conveyed as it is to the drying unit 8. After the drying of the ink on the surface at the drying unit 8, the sheet is guided not to the discharge conveyance unit 10 side route (the third route) but to the reversing unit 9 side route (the second route). In the second route, the sheet is taken up by the take-up rotary member of the reversing unit 9 rotating in the forward direction (counterclockwise as seen in the drawing). When, in the printing unit 4, the planned front-surface printing has all been completed, the trailing end of the printing region of the continuous sheet is cut by the cutter unit 6. Using the cutting position as a reference, the portion of the continuous sheet on the downstream side in the conveyance direction (the printed side) passes the drying unit 8 and is entirely taken-up up to the sheet trailing end (cutting position) at the reversing unit 9. On the other hand, simultaneously with this taking-up, the portion of the continuous sheet left on the upstream side (the printing unit 4 side) of the cutting position in the conveyance direction is rewound on the sheet supply unit 1 so that the sheet leading end (cutting position) may not remain at the decurling unit 2, with the sheet taken-up on the roll R1 or R2. Due to this rewinding, it is possible to avoid collision with the sheet supplied again in the back-surface printing sequence described below.

After the front-surface printing sequence described above, the printing operation is switched to the back-surface printing sequence. The take-up rotary member of the reversing unit 9 rotates in a direction opposite to that at the time of taking-up (clockwise as seen in the drawing). The end portion of the taken up sheet (the sheet trailing end at the time of taking-up becomes the sheet leading end at the time of sending out) is sent into the decurling unit 2 along the route indicated by the dashed line in the drawing. In the decurling unit 2, the curl given by the take-up rotary member is corrected. More specifically, the decurling unit 2 is provided between the sheet supply unit 1 and the printing unit 4 in the first route, and provided between the reversing unit 9 and the printing unit 4 in the second route, constituting a common unit exerting a decurling function in either route. The sheet that has been reversed is sent to the printing unit 4 by way of the skew feed correction unit 3, and printing is performed on the back surface of the sheet. The sheet that has undergone printing passes the inspection unit 5, and is cut in a predetermined unit length by the cutter unit 6. Since the cut sheet has undergone printing on both sides thereof, no recording is performed thereon at the information recording unit 7. The cut sheets are conveyed one by one to the drying unit 8, and pass the discharge conveyance unit 10 before being successively discharged to and stacked in the discharge unit 12. In this way, in the two-sided printing, the sheet is passed and processed in the order: the first route, the second route, the first route, and the third route.

Figure 5:
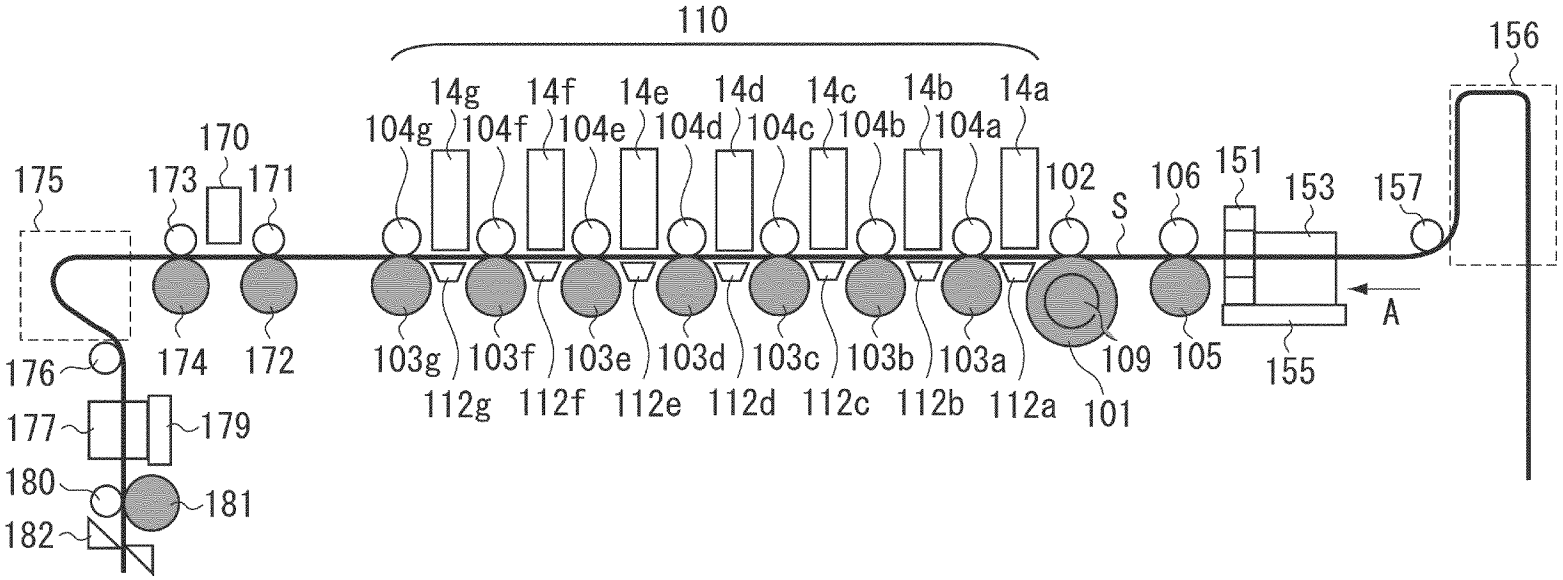
FIG. 5 is a detailed sectional view illustrating the construction of a printing unit.
Figure 6:
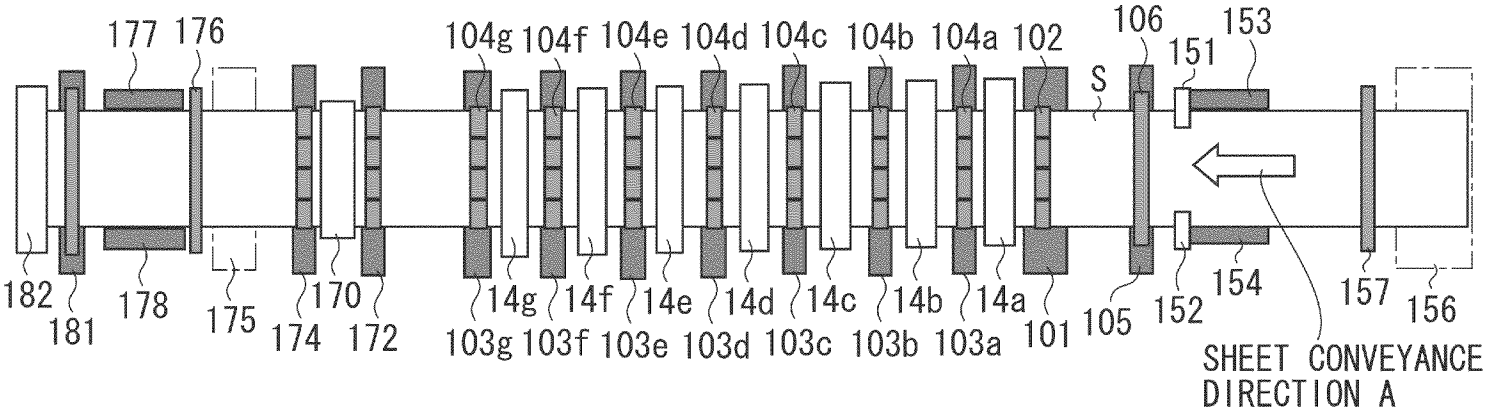
FIG. 6 is a detailed top view illustrating the construction of the printing unit.
Figure 7:
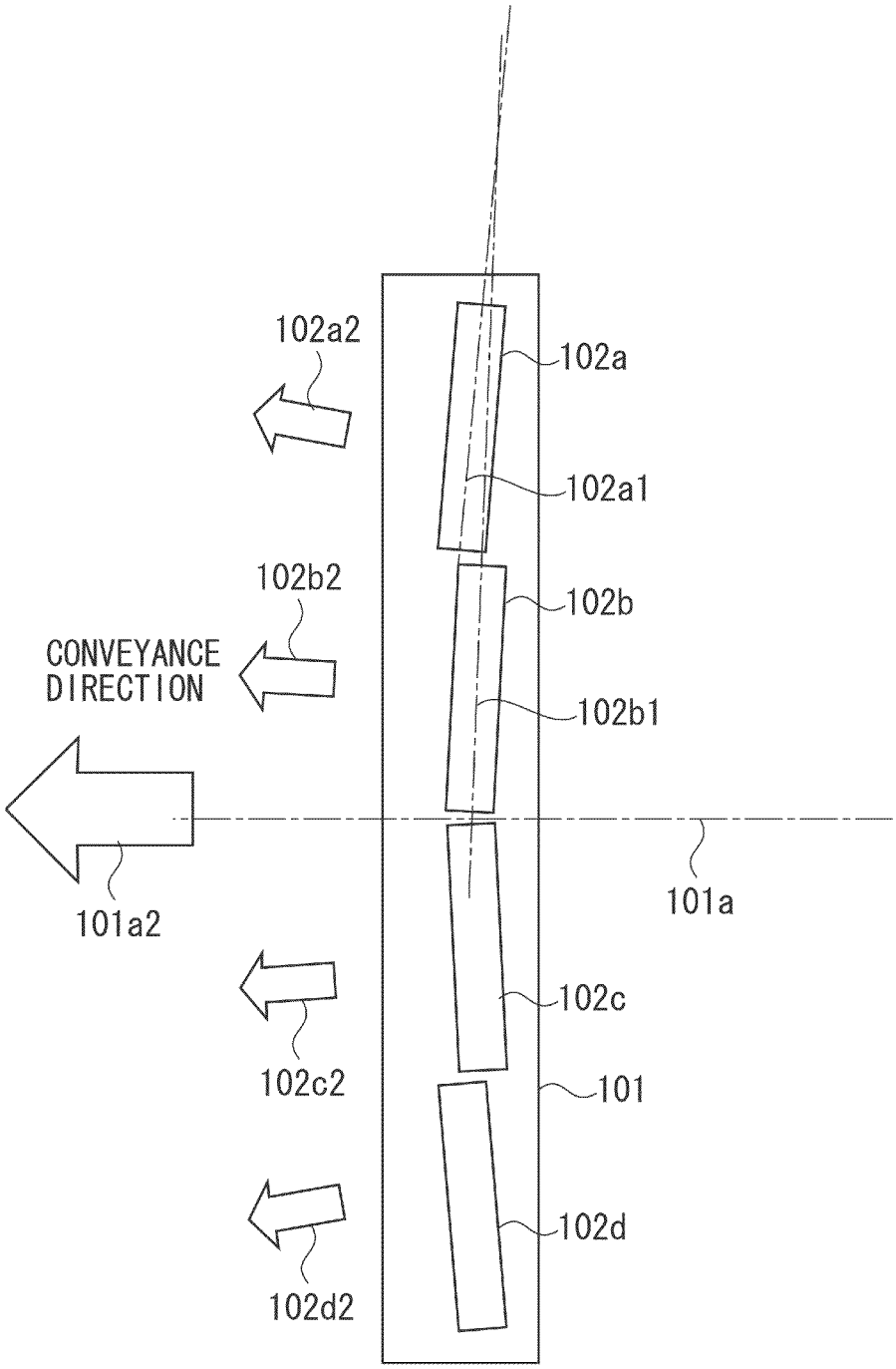
FIG. 7 is a diagram illustrating a conveyance roller and pinch rollers.

Next, the printing unit 4 in the printer constructed as described above will be illustrated in more detail. FIGS. 5 and 6 are schematic views of the printing unit 4. FIG. 7 is a schematic view of a second roller pair. In the printing unit 4, the sheet S is conveyed in the direction of the arrow A in the drawing by three roller pairs: the second roller pair, a third roller pair, and a first roller pair. The second roller pair is a roller pair consisting of a conveyance roller 101 having a driving force and a pinch roller 102 adapted to be driven to rotate. The pinch roller 102 conveys the sheet while pinching the same in cooperation with the conveyance roller 101.

As shown in FIG. 7, the pinch roller 102 is divided into four, perpendicularly to the sheet feeding direction, and consists of four pinch rollers 102*a*, 102*b*, 102*c*, and 102*d*.

The rotation shaft of each of the pinch rollers 102*a*, 102*b*, 102*c*, and 102*d* is inclined such that its end portion which is provided nearer to the center 101*a* of the conveyance path than the end portion on the conveyance path edge, is situated on the downstream side in the conveyance direction. Due to this inclination, the pinch rollers exert oblique conveyance forces 102*a*2, 102*b*2, 102*c*2, and 102*d*2 on the sheet.

During the conveyance of the sheet, the pinch roller 102*b* exerts on the sheet the oblique conveyance force 102*b*2, which is inclined to the right with respect to the conveyance direction 101*a*2 of the conveyance roller 101, and the pinch roller 102*c* exerts on the sheet the oblique conveyance force 102*c*2, which is inclined to the left. As a result, a force expanding the sheet is exerted on the sheet.

Of the pinch rollers adjacent to each other, the pinch roller 102*a* farther from the center 101*a* of the conveyance path (i.e., nearer to the conveyance path side end) than the pinch roller 102*b* which is nearer to the center 101*a* has the rotation shaft 102*a*1 more greatly inclined than the rotation shaft 102*b*1. Due to the inclination of the oblique conveyance forces, a force expanding the sheet is exerted on the sheet between the pinch roller 102*a* and the pinch roller 102*b*. Thus, in any combination of the adjacent pinch rollers, a force expanding the sheet is exerted between the pinch rollers.

In each pinch roller, a pressurization force in the conveyance roller direction is generated by a spring (not shown); by setting a proper pressurization force for each pinch roller, it is possible to secure a satisfactory conveyance precision at the printing unit. Further, each pinch roller allows a change in pressure in correspondence with the kind of sheet conveyed and the sheet width. The third roller pairs include seven roller pairs consisting of a plurality of downstream side sub conveyance rollers 103*a* through 103*g* having a driving force and a plurality of downstream side sub conveyance rollers 104*a* through 104*g* adapted to be driven to rotate. The first roller pair is a roller pair consisting of an upstream side sub conveyance roller 105 having a driving force and an upstream side sub pinch roller 106 (driven roller) adapted to be driven to rotate. The upstream side sub pinch roller 106 has a length in the width direction larger than the length of the sheet width, and is held in contact over the entire sheet width. The pinch roller pressurization force of the second roller pair is set to be variable within a range of approximately 78.45 to 137.28 N in total. Each pinch roller pressurization force of the third roller pair is set to approximately 2.94 N. The pinch roller pressurization force of the first roller pair is set to approximately 9.81 N. The conveyance roller 101 is provided with a rotary encoder 109 for detecting the roller rotating condition.

In a printing region 110 on the downstream side of the first conveyance roller pair, along the sheet conveyance direction, seven line type printing heads 14*a* through 14*g* are arranged respectively corresponding to the different colors. The line type printing heads 14*a* through 14*g* and the downstream side sub pinch rollers 104*a* through 104*g* are arranged alternately. At positions opposed to the printing heads 14*a* through 14*g*, platens 112*a* through 112*g* are provided; when the leading edge of the sheet S passes the printing heads 14*a* through 14*g*, it is guided to the third roller pair. At each of the positions opposed to the printing heads 14*a* through 14*g*, both sides of the sheet S are nipped by the roller pairs, so that the sheet conveyance behavior is stabilized. In particular, when the sheet is introduced for the first time, the leading edge of the sheet passes a plurality of nipping positions at a short cycle, so that the rising of the sheet leading edge is suppressed, and the sheet is introduced in a stable manner.

Numeral 156 indicates an upstream loop portion, and numeral 157 indicates a loop guide for controlling the loop configuration. In the vicinity and on the downstream side of the loop portion 156, a pair of meandering suppressing guides 153 and 154 are arranged, which are a first guide and a second guide. Further, in the vicinity and on the downstream side thereof, there are provided sheet edge sensors 151 and 152, which are detection units for detecting the sheet edge position.

Figure 8:
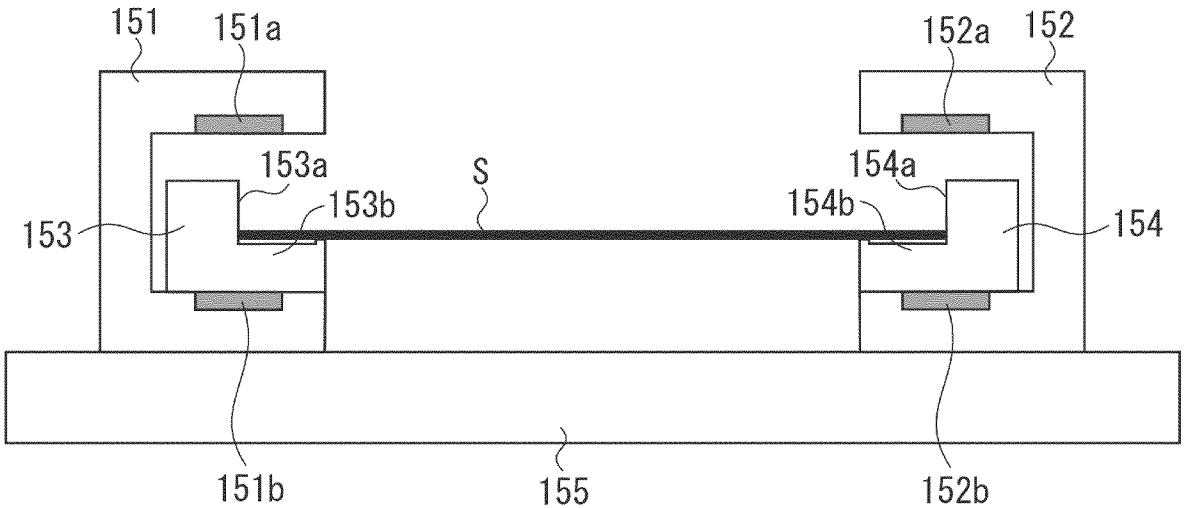
FIG. 8 is a detailed explanatory view of a meandering correction guide unit.

Referring to FIG. 8, the construction of the guides and of the sheet edge sensors will be described in more detail. The meandering suppressing 153 and 154, which are guide units, are provided with abutment surfaces 153*a* and 154*a* abutting a first side end portion of the sheet and a second side end portion on the opposite side thereof to suppress meandering. Further, they are also provided with guide surfaces 153*b* and 154*b* for guiding the lower surface of the sheet. The sheet edge sensors 151 and 152 are transmission type position detection sensors using infrared rays. Infrared rays are emitted from light emitting portions 151*b* and 152*b*, and the sheet edge position is detected from the light reception amount at light receiving portions 151*a* and 152*a*. Numeral 155 indicates a movement guide for moving the sheet edge sensors 151 and 152 and the meandering suppressing guides 153 and 154 in the sheet width direction. The movement guide is formed by a lead screw (not shown) and a drive motor. The meandering suppressing guide 153 and the sheet edge sensor 151 are integrally fixed, and are capable of integral movement to an arbitrary position due to the movement guide 155. The sheet edge abutment surface 153*a* and sensor portions 151*a* and 151*b* of the sheet edge sensor 151 undergo an adjustment assembly in which assembly is performed simultaneously with position measurement, whereby the assembly is effected substantially with no error of distance. The guide 154 arranged at the opposite side end portion of the sheet and the sheet edge sensor 152 are of a similar construction. Further, the guide undergoes an adjustment assembly to be perpendicular to the first conveyance roller pair. The first conveyance roller pair is of the maximum sheet conveyance force and has a dominant influence on the conveyance precision, so that there is no fear of an extremely great meandering correction being effected with respect to the conveyance direction through perpendicularity adjustment of the guide, making it possible to easily perform conveyance with high precision.

Figure 10:
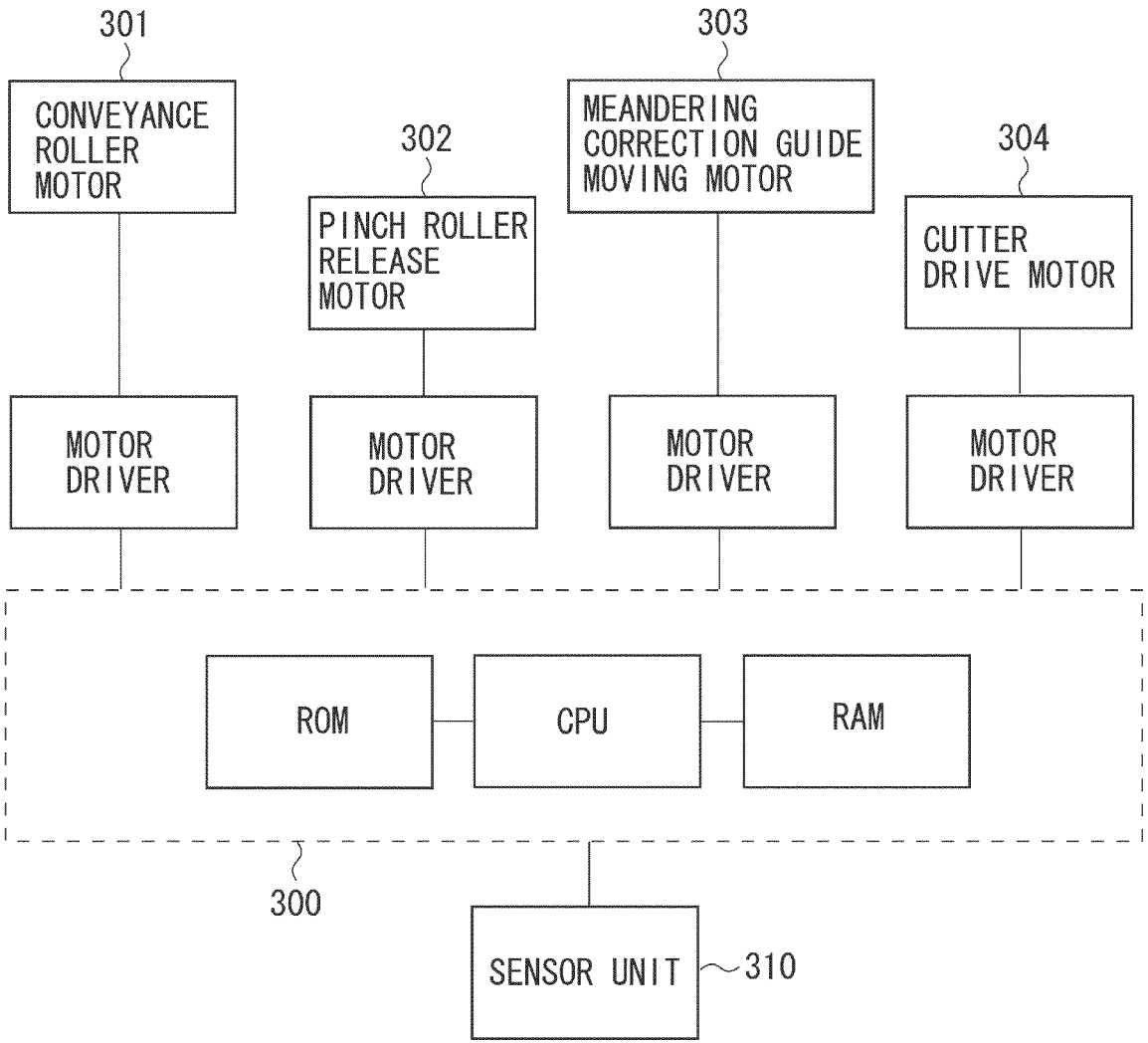
FIG. 10 is an explanatory view of a control unit for a conveyance unit and a meandering correction unit.

Numeral 170 indicates a scanner, numerals 172 and 174 indicate scanner rollers for performing sheet conveyance before and after the scanner, and numerals 171 and 173 indicate pinch rollers for pressurizing the sheet. Numeral 175 indicates a downstream loop portion arranged between the scanner 170 and a cutter 182. Numeral 176 indicates a second loop guide for controlling the loop configuration. Numerals 177 and 178 indicate second guides, and numeral 179 indicates a third movement guide for moving the second guides to an arbitrary position in the sheet width direction. Numeral 181 indicates a pre-cutter conveyance roller, and numeral 180 indicates a pinch roller for pressurizing the sheet. FIG. 10 is a schematic view illustrating the construction of a control unit. A controller 300 has a ROM, a RAM, and a CPU. A sensor unit 310 is a sensor group for detecting the condition of the apparatus. Numeral 301 indicates a conveyance roller motor for driving each conveyance roller conveying the sheet, and numeral 302 indicates a pinch roller release motor performing a pinch roller release operation to change/release the nip pressure of the conveyance roller. Numeral 303 indicates a motor for moving the guides, and numeral 304 indicates a motor for operating the cutter, with each motor performing control by each motor driver.

The sheet conveyance operation in the above construction will be described. The sheet S supplied from the sheet supply unit 1 forms a loop at the loop portion 156, and then passes the guide pair 153, 154 before being conveyed via the first roller pair, the second roller pair, and the third roller pair in that order while nipped at a predetermined nip position at each of them. The conveyance route from the second roller pair to the first roller pair and the guide pair 153, 154 is linear. Here, the adjective "linear" is not to be construed in the strict sense of the word; it also covers a substantially linear form.

Figure 9:
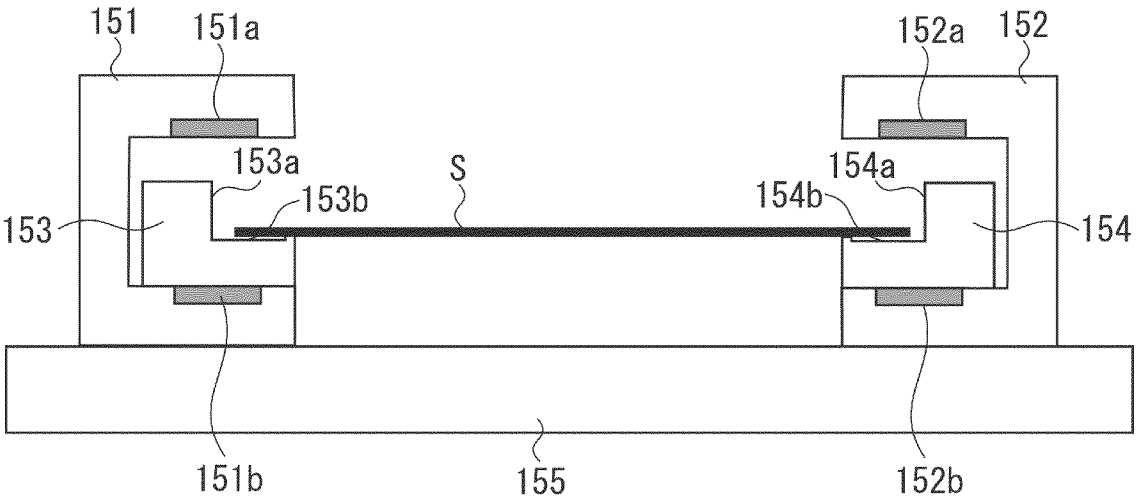
FIG. 9 is a detailed explanatory view of the meandering correction guide unit.

Here, the meandering suppressing guides 153 and 154 are on standby at first at positions spaced apart from the sheet edge as shown in FIG. 9. After the sheet leading edge has passed the meandering suppressing guides, the sheet edge is detected by the sheet edge sensors 151 and 152. Next, based on the sheet edge detection result, the meandering suppressing guides are moved to positions where they abut sheet edges (FIG. 8). As described above, the meandering suppressing guides 153 and 154 and the sheet edge sensor are integrally moved after positional adjustment, so that the sheet edges and the meandering correction guides can be matched with each other with high precision. Thus, it is possible to suppress to the minimum the buckling or deformation of the sheet caused by excessive pushing-in of the sheet edges by the meandering suppressing guides. Further, there is no fear of a reduction in the meandering suppressing effect due to excessive opening of the gaps between the sheet edges and the meandering suppressing guides.

On the downstream side of the meandering suppressing guides 153 and 154, the upstream side sub conveyance roller 105 and the driven upstream side sub pinch roller 106 are arranged, which constitute the first roller pair. The upstream side sub pinch roller 106 has an outer peripheral surface held in contact with the continuous sheet over the entire width thereof, with its length in the width direction being not less than the sheet width. Even if twisting or rising is generated in the continuous sheet as a result of the meandering suppressing guides 153 and 154 abutting the edges of the continuous sheet, it is possible to suppress extension of such rising or twisting to the downstream side by holding the continuous sheet by the upstream side sub conveyance roller 105 and the upstream side sub pinch roller 106.

The second roller pair is composed of the conveyance roller 101 and a plurality of pinch roller 102, so that they can apply uniformly distributed pressure to the sheet, making it possible to convey the sheet without damaging the sheet and with high conveyance precision. Here, even if slight buckling of the sheet occurs in the vicinity of the second roller pair, the buckling of the sheet grows between the plurality of pinch rollers 102, inducing creases. However, in the present construction, even if the buckling of the sheet is caused by the meandering suppressing guides, such buckling or deformation of the sheet is completed on the upstream side of the first roller pair, so that no buckling of the sheet occurs in the vicinity of the second roller pair; thus, no paper creases are generated. Further, in any combination of the adjacent pinch rollers 102, the pinch rollers exert an oblique conveyance force expanding the sheet in the width direction. As a result, even if the buckling of the sheet occurs in the vicinity of the second roller pair, the sheet is conveyed so as to smoothen away the buckling, and no creases are generated. Further, in the case of the kind of sheet of low rigidity or a sheet of a width half overlapping the pinch rollers, the buckling of the sheet is likely to occur. However, by changing the pressurization force of the pinch rollers 102 according to the kind of sheet and the sheet width, it is possible to prevent generation of creases.

After this, the sheet leading end portion is conveyed by a conveyance roller pair of the printing unit. Here, to convey the sheet ends along the meandering suppressing guides against a force striving to cause meandering of the sheet, it is optimum to adopt a construction in which the sheet is easily allowed to turn using the meandering suppressing guides as fulcrums. In the present construction, a loop portion 156 is provided on the upstream side of the meandering suppressing guides 153 and 154. Thus, even if a force striving to cause meandering is exerted during the conveyance by the conveyance roller pairs, the loop portion on the upstream side and in the vicinity of the meandering suppressing guides allows the sheet to move in the sheet width direction freely to some degree. Since the sheet is movable at the loop portion, the sheet on the downstream side is rotatable using the meandering correction guides as fulcrums, allowing the sheet to be easily conveyed along the meandering correction guides. To enhance the feeding precision in the sheet conveyance direction, it is effective to make the pressurization force of the conveyance roller higher than a fixed pressure according to the kind and size of the sheet. Further, to effect meandering correction, it is effective to make the pressurization force lower than a fixed pressure according to the kind and size of the sheet. In the present construction, there is adopted a pressure making the conveyance precision and the meandering correction compatible with each other. Examples of the force generating the meandering by the conveyance roller pair include a force due to non-uniformity in the sheet width direction of the pressurization force of the pinch roller and a force due to the cylindricality (outer diameter error) in the sheet width direction of each roller. In a case where, unlike the above construction, a conveyance roller pair having a sheet conveyance force is also installed on the upstream side of the meandering correction guides, the sheet is constrained by the roller pair on both the upstream side and the downstream side of the meandering correction guides. Due to this constraint, it can happen that, even if an attempt is made to convey the sheet along the meandering correction guides, the attitude of the sheet cannot be easily changed, resulting in buckling of the sheet or breakage of the end portion thereof depending upon the kind of sheet used. In particular, this is likely to occur in the case where the sheet rigidity is low.

After having passed the scanner 170, the sheet forward end portion forms a loop at the downstream loop portion 175, and is conveyed between second meandering correction guides 177 in conformity with the sheet width. After this, the sheet is conveyed by the pre-cutter roller pair 180, 181, and is cut in a predetermined size by the cutter 182 as needed.

While in the above exemplary embodiment line type printing heads for the different colors are provided in the printing unit 4, a similar construction is also possible in the case, for example, of a serial type single printing head. Further, one of the meandering correction guides, abutting a sheet end portion, may be pressed against the sheet end portion by an elastic member such as a spring. In this case, a slight positioning error in the meandering correction guides with respect to the sheet end portions can be absorbed depending upon the kind of sheet, so that the margin with respect to sheet buckling is further increased. The meandering correction guide proves effective if provided for only one sheet end portion. In this case, the sheet is constantly pressed against one side by an oblique-run roller or the like.

The printing apparatus of the above-described exemplary embodiment has a conveyance roller nip-conveying a sheet to the upstream side of the printing unit 4, and a plurality of pinch rollers opposed to the conveyance roller and arranged divisionally in a direction perpendicular to the sheet feeding direction. On the upstream side of the conveyance roller, there are provided an upstream side sub conveyance roller nip-conveying the sheet, and an end portion guide member abutting at least one side end portion of the sheet on the upstream side of the conveyance roller pair to guide the sheet end portion. There is provided a guide movement unit for moving the end portion guide member in a direction orthogonal to the sheet conveyance direction. Due to this construction, it is possible to attain compatibility between conveyance precision and meandering precision at high level. As a result, it is possible to provide a printing apparatus of high printing quality.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet conveyance apparatus comprising:

a drive roller configured to convey a sheet in a first direction, the drive roller having a rotational shaft extending along a second direction crossing the first direction and having a first half and a second half with respect to a center of the drive roller in the second direction; and a plurality of pinch rollers including a first pinch roller, a second pinch roller, a third pinch roller and a fourth pinch roller, each configured to pinch the sheet in cooperation with the drive roller, the first pinch roller being positioned nearer to the center than the second pinch roller in an area corresponding to the first half, and the third pinch roller being positioned nearer to the center than the fourth pinch roller in an area corresponding to the second half, wherein the first pinch roller includes second and third pinch roller side ends and is provided in a manner such that the third pinch roller side end is located on a downstream side, in the first direction and for a first amount, of the second pinch roller side end, wherein the second pinch roller includes a first pinch roller side end and other side end and is provided in a manner such that the first pinch roller side end is located on a downstream side, in the first direction and for a second amount being larger than the first amount, of the other side end, wherein the third pinch roller includes first and fourth pinch roller side ends and is provided in a manner such that the first pinch roller side end is located on a downstream side, in the first direction and for a third amount, of the fourth pinch roller side end, and wherein the fourth pinch roller includes a third pinch roller side end and other side end and is provided in a manner such that the third pinch roller side end is located on a downstream side, in the first direction and for a fourth amount being larger than the third amount, of the other side end.

2. The apparatus according to claim 1, further comprising a roller pair provided downstream in the first direction of the drive roller, wherein a total pressure between the drive roller and the plurality of pinch rollers is greater than a pressure between the roller pair.

3. The apparatus according to claim 2, further comprising a guide provided upstream in the first direction of the drive roller for guiding one side of the sheet being conveyed.

4. The apparatus according to claim 2, further comprising a line head provided between the drive roller and the roller pair, configured to be adapted to print images on a sheet.

5. The apparatus according to claim 1, wherein the third amount is equal to the first amount and the fourth amount is equal to the second amount.

6. A sheet conveyance apparatus comprising:

a drive roller configured to convey a sheet in a first direction, the drive roller having a rotational shaft extending along a second direction crossing the first direction; and a plurality of pinch rollers including a first pinch roller, a second pinch roller, a third pinch roller and a fourth pinch roller, each configured to pinch the sheet in cooperation with the drive roller, the first pinch roller being positioned nearer to a center of the drive roller in the second direction than the second pinch roller in an area between the center and a first end of the drive roller in the second direction, and the third pinch roller being positioned nearer to the center of the drive roller in the second direction than the fourth pinch roller in an area between the center and a second end of the drive roller in the second direction, wherein the first pinch roller is provided in a manner such that a center side end is located on a downstream side of the other end in the first direction and for a first amount, wherein the second pinch roller is provided in a manner such that a center side end is located on a downstream side of the other end in the first direction and for a second amount being larger than the first amount, wherein the third pinch roller is provided in a manner such that a center side end is located on a downstream side of the other end in the first direction and for a third amount, and wherein the fourth pinch roller is provided in a manner such that a center side end is located on a downstream side of the other end in the first direction and for a fourth amount being larger than the third amount.

7. The apparatus according to claim 6, further comprising a roller pair provided downstream in the first direction of the drive roller, wherein a total pressure between the drive roller and the plurality of pinch rollers is greater than a pressure between the roller pair.

8. The apparatus according to claim 7, further comprising a guide provided upstream in the first direction of the drive roller for guiding one side of the sheet being conveyed.

9. The apparatus according to claim 7, further comprising a line head provided between the drive roller and the roller pair, configured to be adapted to print images on a sheet.

10. The apparatus according to claim 6, wherein the third amount is equal to the first amount and the fourth amount is equal to the second amount.

11. A sheet conveyance apparatus comprising:

a drive roller configured to convey a sheet in a first direction, the drive roller having a rotational shaft extending along a second direction crossing the first direction; and a plurality of pinch rollers including a first pinch roller and a second pinch roller, each configured to pinch the sheet in cooperation with the drive roller, the first pinch roller being positioned nearer to a center of the drive roller in the second direction than the second pinch roller, wherein the first pinch roller is provided in a manner such that a center side end is located on a downstream side of the other end in the first direction and for a first amount, wherein the second pinch roller is provided in a manner such that a center side end is located on a downstream side of the other end in the first direction and for a second amount being larger than the first amount.

12. The apparatus according to claim 11, further comprising a roller pair provided downstream in the first direction of the drive roller.

13. The apparatus according to claim 12, further comprising a line head provided between the drive roller and the roller pair, configured to be adapted to print images on a sheet.

14. A sheet conveyance apparatus for conveying a sheet on a conveyance path, comprising:

a first roller configured to convey the sheet; and a plurality of first pinch rollers configured to pinch the sheet in cooperation with the first roller, wherein each of the plurality of first pinch rollers is inclined such that an end portion of the pinch roller that is nearer to the center of the conveyance path than another end portion of the pinch roller is located downstream of another end portion of the pinch roller, and wherein the smaller the distance to the conveyance path side end, the greater the inclination of the pinch roller.

15. The sheet conveyance apparatus according to claim 14, further comprising a guide unit held in contact with a side end portion of the conveyed sheet to guide the side end portion of the sheet, wherein the guide unit has a first guide abutting a first side end portion of the sheet and a second guide abutting a second side end portion on the opposite side of the first side end portion;

a detection unit configured to detect the position of the first side end portion; and a movement unit configured to move the first guide to a position where it abuts the first side end portion according to the detection result of the detection unit.

16. The sheet conveyance apparatus according to claim 15, wherein the detection unit detects the position of the second side end portion, and wherein the movement unit moves the second guide to a position where it abuts the second side end portion according to the detection result of the detection unit.

17. The sheet conveyance apparatus according to claim 14, further comprising, a printing unit arranged on a downstream side of the first roller and configured to form an image on a sheet; and a second roller pair arranged on the downstream side of the first roller and in the vicinity of the printing unit and configured to convey the sheet.

18. The sheet conveyance apparatus according to claim 17, wherein in the printing unit, a plurality of line type printing heads are arranged along a sheet conveyance direction.

* * * * *